United States Patent [19]

Fukuda et al.

[11] Patent Number: 4,851,601

[45] Date of Patent: Jul. 25, 1989

[54] PROCESSING FOR PRODUCING HYDROCARBON OILS FROM PLASTIC WASTE

[75] Inventors: Takashi Fukuda; Kiyoshi Saito; Satoru Suzuki, all of Sapporo; Hideki Sato, Fukayasu; Toshio Hirota, Yokohama, all of Japan

[73] Assignee: Mobil Oil Corporation, New York, N.Y.

[21] Appl. No.: 145,009

[22] Filed: Jan. 19, 1988

[51] Int. Cl.[4] ..... C07C 1/00; C07C 4/00

[52] U.S. Cl. ..... 585/241; 208/67; 208/120

[58] Field of Search ..... 585/241; 208/120, 67

[56] References Cited

U.S. PATENT DOCUMENTS

| | | | |
|---|---|---|---|
| 3,441,628 | 4/1969 | Ratzsch et al. | 585/241 |
| 3,901,951 | 8/1975 | Nishizoki | 585/241 |
| 3,956,414 | 5/1976 | Oshima . | |
| 4,108,730 | 9/1978 | Chen et al. . | |
| 4,118,281 | 10/1978 | Yan . | |
| 4,175,211 | 11/1979 | Chen et al. . | |
| 4,251,500 | 2/1981 | Morita et al. | 585/241 |
| 4,437,976 | 3/1984 | Oeck et al. | 208/67 |
| 4,584,421 | 4/1986 | Saito et al. | 585/241 |

FOREIGN PATENT DOCUMENTS

| | | | |
|---|---|---|---|
| 0056718 | 7/1982 | European Pat. Off. | 208/120 |
| 2746380 | 6/1978 | Fed. Rep. of Germany | 208/120 |
| 0071789 | 5/1980 | Japan | 585/241 |
| 607233 | 8/1948 | United Kingdom | 585/241 |

*Primary Examiner*—Patrick P. Garvin
*Assistant Examiner*—E. D. Irzinski
*Attorney, Agent, or Firm*—Alexander J. McKillop; Charles J. Speciale; Malcolm D. Keen

[57] ABSTRACT

Plastic scrap, especially of polyolefin plastics, is converted to low pour point oils by thermal cracking in the liquid phase followed by catalytic conversion of the vaporous cracking products over an intermediate pore size zeolite such as ZSM-5.

8 Claims, 1 Drawing Sheet

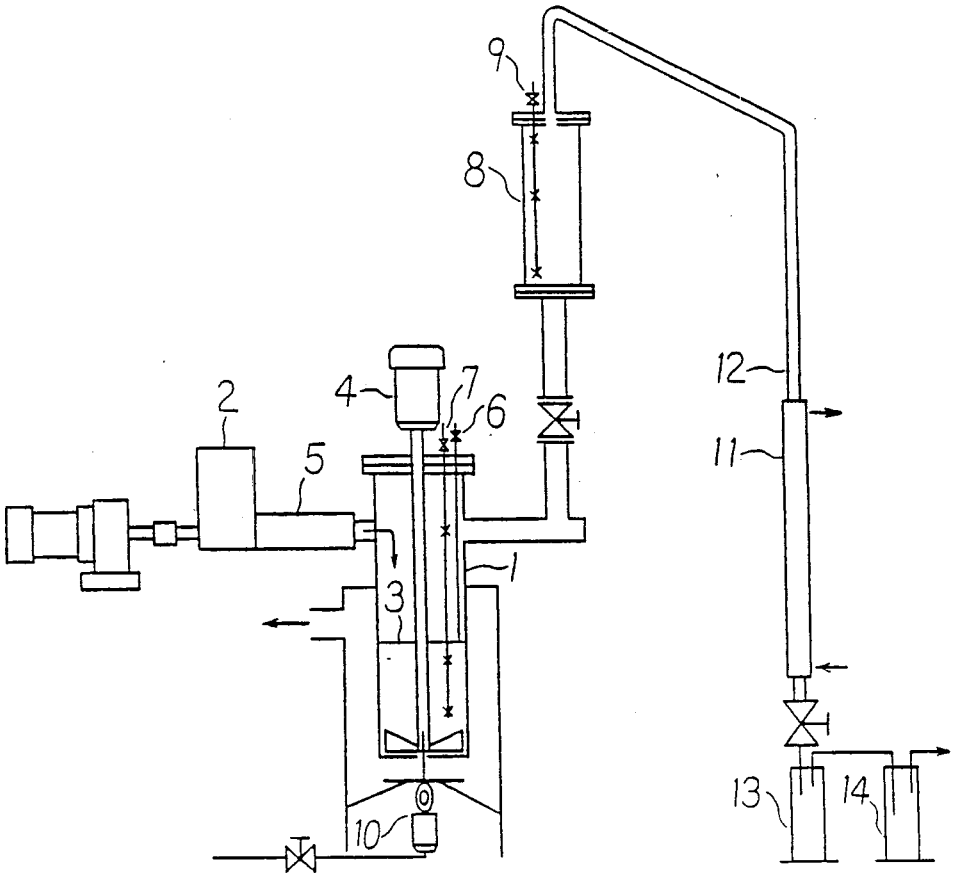
9
8
12
4
7
6
2
5
11
1
3
13
14
10

PROCESSING FOR PRODUCING HYDROCARBON OILS FROM PLASTIC WASTE

FIELD OF THE INVENTION

The present invention relates to a process for preparing low boiling hydrocarbon oils whih ae useful as the raw material for the production of gasoline, from polyolefin plastics as the starting material.

BACKGROUND OF THE INVENTION

It is well known that as quantity of plastics manufactured increases in recent years, the disposal of the scrap has become a problem. There are some plastics for which the technology for recycling has been developed to a practical stage for recycling of polyolefin plastics, which are said to represent approximately one half of the quantity of thermoplastic resins manufactured in Japan, has not yet become satisfactory and effective for practical use except on a small scale. Thermal cracking methods, as described for example, in U.S. Pat. No. 3,956,414 (Oshima), are disadvantageous because considerable amounts of waxy materials are formed, and also because carbon is formed and becomes attached to the inner walls of the reaction vessels used for the processing. It has therefore not been practicable to put these methods to practical use for commonly used plastics.

Proposals for processing scrap plastics have been made in the past. For example, U.S. Pat. Nos. 4,108,730 and 4,175,211 (Chen) disclose a process for converting polymeric wastes such as rubber tires, plastic ware and scrap plastic to more valuable liquid, solid and gaseous hydrocarbon products by mixing the waste with a refractory petroleum stream and catalytically cracking the mixture. Suitable petroleum streams include fractions produced by catalytic cracking, for example, heavy cycle oil (HCO). The disadvantage of this method is, however, that it needs to be operated in proximity to a catalytic cracker which therefore precludes it from being used on a relatively smaller scale close to the source of the plastic waste. In addition, relatively large volumes of the petroleum stream are necessary for mixing with the scrap.

U.S. Pat. No. 4,118,281 (Yan) describes a process for converting solid wastes including rubbers, plastics and other material to gas, oil and coke by slurrying the waste with a petroleum stream, especially the heavy recycle fraction from a coker unit and coking the resulting mixture. The products of the coking may be used as a catalytic cracker feed to produce high yields of gasoline. Although this process is compatible with conventional petroleum refining technology it also requires to be carried out at the refinery and requires relatively large volumes of the petroleum stream to dissolve or slurry the waste before it is coked. It would be desirable to eliminate the necessity for using the separate petroleum stream for mixing with the waste so as to permit the process to be carried out effectively close to the soure of the waste with only the high value liquid conversion products being transported off-site.

SUMMARY OF THE INVENTION

We have now devised a process for producing high-quality hydrocarbon oils of low boiling point and low pour point by more efficiently conducting thermal and selective catalytic cracking of polyolefinic plastics by a two-stage treatment which does not require the use of separate refinery streams for its operation.

According to the present invention, a process for preparing a hydrocarbon oil of low boiling point and low pour point comprises thermally cracking molten plastics in the liquid phase and catalytically converting the vaporous cracking product by contact with an intermediate pore size zeolite.

THE DRAWINGS

The single FIGURE of the accompanying drawings is a simplified schematic diagram of an apparatus suitable for carrying out the present process.

DETAILED DESCRIPTION

The plastics which may be used in the present process may be selected from a wide range of hydrocarbon and oxygenated hydrocarbon plastic resin materials although halogenated plastics such as the halogenated vinyl polymers e.g. polyvinyl chloride (PVC) and the halo-vinylidene polymers such as poly (vinylidene dichloride), should not be used in order to avoid catalyst deactivation. The process is of greatest utility with hydrocarbon polymers including, especially, polyolefins such as polyethylene, polypropylene, polybutene, and polymers and copolymers of these and other unsaturated hydrocarbon monomers. Polyvinyl aromatics such as polystyrene e.g. foamed polystyrene, and poly (paramethyl-styrene) and copolymers e.g. with cross-linking comonomers such as divinylbenzene (DVB) may also be recovered by the present process as may oxygenated polymers such as polyesters e.g. polyethylene terephthalate (PET), polyacrylates e.g. poly (methyl methacrylate), polycarbonates and other such polymers. The principal utility of the process will, however, be with polyolefins in view of the extent to which they are used at the present.

Before the plastic scrap is treated by the present process it should be shredded or otherwise reduced to a particulate state. Usually, the scrap will be in any form of film, sheet, moldings and the like, but preferably will be films and sheets used for agricultural or horticultural purposes. Separation of non-plastic materials which may accompany the scrap e.g. paper, dirt, may be effected by washing and drying or other suitable classification techiques. These materials, after shredding or pulverizing by appropriate means, are continuously fed to a thermal cracking zone e.g. a reaction tank, by means of an extruder while being heated to a softened and molten state.

It is essential to carry out the first stage thermal cracking of the plastic in the molten or liquid phase. The temperature in the thermal cracking reaction zone at the first stage is typically at least 360° C. and preferably 390°-500° C., more preferably 420°-470° C. e.g. 400°-450° C. It is preferred to feed the molten plastic into the first stage thermal cracking reacting zone in such a way the the level of the molten liquid phase is maintained constant, preferably with stirring or other agitation to maintain uniform conditions. Pressures in the thermal cracking zone may be atmospheric or superatmospheric, as required in order to maintain the liquid phase in the vessel at the desired reaction temperature for the cracking to proceed. Atmospheric pressure operation is preferred.

In order to improve heat transfer during the thermal cracking it is preferred to employ a particulate, solid, inorganic component in the cracking reactor. This is preferably a porous material, preferably with a particle size of about 1-10 mm. There are no particular limitations on the material used provided that it is essentially free of deformation or deterioration in the cracking process. Suitable inorganic materials include matural zeolites, bauxite or the residues produced by the removal of aluminum from bauxite (sometimes referred to as "red mud"). The solid material may be essentially inert to the thermal cracking process or it may possess some cracking activity e.g. with natural or synthetic zeolites such as faujasite but such acidic cracking activity should be lower than that of the zeolite used in the second stage of the process in order to ensure that a significant degree of selective catalytic conversion occurs in the second stage in the presence of the intermediate pore size zeolite. However, since the use of a solid with cracking activity may promote conversion in the first stage its use may be regarded as desirable.

Use of such inorganic particulate material inhibits attachment of carbon to the walls of the reaction vessel as well as lowering the boiling point of the vaporous cracking products. It has also been found to improve the quality and yield of the final hydrocarbon oil from the process. The amount of the inorganic particulate material is preferably 5% by weight or more of the higher e.g. 100-500 percent of the molten plastic e.g. 200-400 percent, by weight.

The vaporous product thus formed in the first-stage thermal cracking reaction tank which has a pronounced paraffinic character is then pased to the bed filled with the intermediate pore size zeolite for catalytic conversion to higher quality products. The yield of the vaporous thermal cracking products is typically at least 80 weight percent and in most cases above 90 weight percent.

In the second stage of the process, the vaporous thermal cracking products from the first stge are converted by contact with an acidic, intermediate pore size zeolite at an elevated temperature. The intermediate pore size zeolites are zeolites which have a structural unit comprised of ten-membered oxygen ring systems, as described in *J. Catalysis* 67, 218-222 (1981) and *Catal. Rev. - Sci. Eng.* 28 (2&3) 185-193 (1986). The intermediate pore size zeolites are characterized by a Constraint Index of 1 to 12, as disclosed in U.S. Pat. Nos. 4,016,218 and 4,696,732 to which reference is made. These zeolites also and preferably have a silica:alumina ratio (structural) of at least 12:1 as described in U.S. Pat. No. 4,016,218.

Examples of this type of zeolite include ZSM-5, ZSM-11, ZSM-12, ZSM-23, ZSM-35, ZSM-38 and ZSM-48. ZSM-5 is preferred. ZSM-5 is a crystallize zeolite having, in the as-synthesized form, the following lines in the X-ray diffraction pattern:

| Interplanar Spacing | Relative Intensity |
|---|---|
| 11.2 ± 0.2 | S |
| 10.1 ± 0.2 | S |
| 3.86 ± 0.08 | VS |
| 3.72 ± 0.08 | S |
| 3.66 ± 0.05 | M |

The zeolite is usually used in acid or hydrogen form, generally produced by calcining the ammonium-exchanged form of the zeolite. A hydrogenation metal component such as platinum, palladium, nickel or another transition metal, preferably as Group VIII may be present, either exchanged onto or impregnated into the zeolite e.g. in amounts from 0.1-10 weight percent. The zeolite is usually used either as it is or after forming e.g. by extrusion in any shape having a particle size of about 0.1-10 mm, together with a binder such as alumina, silica or silica-alumina.

The second stage catalytic conversion reaction is typically carried out at a temperature usually of at least 200° C. and preferably of 250°-340° C. Operation at such low temperatures brings about not only the desired improvement in the product oil but also inhibits undesirable side reactions and other effects. Space velocities are typically at least 0.5 WHSV and usually 0.5-2.0 WHSV with values of about 0.75-1.0 being preferred. Atmospheric pressure operation is preferred although higher pressures may be used if desired. The heat requirement for the second is readily met by the incoming vapors from the first stage thermal cracking and therefore no separate heating is required for the second-stage feed or the reactor provided excessive heat losses are avoided.

The use of the zeolite not only enables decreases in temperature to be used in continuous operation but also remarkably improves the quality and yield of the product. The activity of the catalyst is maintained even after repeated use and regeneration. Even regenerated catalysts previously used in other reactions e.g. catalytic cracking or catalytic dewaxing, may be effectively used in the present process.

The hydrocarbon oil product has good fluidity characteristics at low temperatures i.e. the portion boiling above the gasoline boiling range e.g. 165° C.+, has a low pour point. This is indicative of hte occurrence not only of cracking reactions over the zeolite but also of isomerization reactions. The absence of high molecular weight components in the product is also to be noted. In many cases, the hydrocarbon oil product contains no substantial amount of hydrocarbons having 22 or more carbon atoms and the quantity of non-distillable residua is normally very small.

The product typically contains significant quantities of olefins produced by the cracking reactions together with saturates and minor quantities of aromatics derived by aromatization of paraffins. The product is, notwithstanding the relatively high olefin content, colorless, stable and clear. A typical analysis is as follows:

TABLE 1

| Product Analysis | Wt. Pct. |
|---|---|
| Saturates | 38.4 |
| Olefins | 54.7 |
| Aromatics | 4.5 |
| RON (clear) | 62.5 |

The gaseous by-products produced by the process under certain temperature conditions contain useful $C_3$-$C_5$ components. The liquid yield is typically at least 50 weight percent and in most cases over 60 weight percent of the plastic material charged, as shown in a typical case below.

TABLE 2

| Typical Material Balance | Wt Pct on Feed |
|---|---|
| Feed Polyethylene | 100 |
| Products: | |
| Liquid | 62 |
| Gas | 31 |

TABLE 2-continued

| Typical Material Balance | Wt Pct on Feed |
|---|---|
| Level Charge | 1 |
| Carbon etc | 1 |
| | 100 |
| Fuel Consumed | 27 |

The properties of products produced from two commercial plastics, polyethylene(PE) and polystyrene (PS) are shown below in Table 3.

TABLE 3

| Typical Product Properties (Liquid) | | |
|---|---|---|
| Feed | Polyethylene | Polyethylene/Polystyrene 90/100 |
| Product: | | |
| Sp. Gr. | 0.7498 | 0.7878 |
| RVP, kg/cm$^2$ | 0.78 | 0.45 |
| (psi) | (8.65) | (6.4) |
| RON | 62.5 | 69.8 |
| Distillation, °C. | | |
| IBP | 30 | 38 |
| 5% | 44 | 72 |
| 10% | 60 | 89 |
| 20% | 84 | 115 |
| 30% | 108 | 136 |
| 40% | 132 | 157 |
| 50% | 159 | 182 |
| 60% | 186 | 217 |
| 70% | 216 | 257 |
| 80% | 245 | 295 |
| 90% | 279 | 334 |
| 95% | 299 | 355 |
| EP | 316 | 370 |
| Res, vol % | 1.5 | 2.0 |

The equipment which may be used for the reactions is shown in the FIGURE. The two stage unit 1 comprises a feed supply zone 2, a thermal cracking reaction zone 3 with a stirrer 4 mounted on its top. At the bottom of feed supply zone 2 the screw feeder 5 is provided which is directed into the top of thermal cracking reaction zone 3. A level meter 6 to measure height position of the molten feed and a thermometer 7 are inserted inside the thermal cracking reaction zone 3. At the bottom of the thermal cracking reaction zone 3 is provided a gas burner 10 in the zone jacket for supplying heat to the zone and maintaining it at the desired temperature for the cracking reactions.

At the top of thermal cracking reaction zone 3 a catalytic reaction zone 8 is provided which is filled with a fixed bed of H-ZSM-5 having a particle size of about 3 mm into which is also inserted a thermometer 9.

The thermal cracking reaction zone 3 is maintained at a predetermined inner temperature for the thermal cracking reaction, and the catalytic reaction zone 8 is maintained at a predetermined temperature in the range typically between 250°–350° C. by means of heat carried in by the vaporous product and an external heater jacket.

The polyolefinic plastic placed in the feed supply zone 2 is melted and passed into thermal cracking reaction zone 3 through screw feeder 5 and subjected to thermal cracking at a predetermined temperature. The vaporous product formed by the thermal cracking is then subjected to conversion at the predetermined temperature in the course of being passed through the catalytic reaction zone 8 to give the desired low molecular products.

The upper end of the catalytic reaction zone 8 is connected to a cooling under 12 equipped with a water-cooled condensor 11. Product storage tanks 13 and 14 are provided at the end of the cooling tube 12. Thus, in a typical case, the product which is converted to a low molecular weight components in the catalytic reaction zone 8 is cooled to +11.5° C. in the course of passing through the cooling tube 12 and collected in storage tanks 13 and 14.

The results of experiments for producing hydrocarbon oils from polyolefin plastics using the above-described equipment are described below.

(1) Screw Feeder

A feeder of two-axis screw type was operated at a temperature of 330° C. and a supply rate of 680–706 g/hr.

(2) Reaction Zones

First stage reaction tank

A tank 560 mm in height, 105 mm in inner diameter and 4.85 l. in volume in which the thermal cracking reaction zone is 250 mm in height. This zone was filled with 250 g of a particulate natural zeolite produced in Kasaoka, Japan (particle size of approximately 0.5 mm) and stirred at 8 rpm.

Second stage reaction tower

A tower 300 mm in height, 76 mm in inner diameter and 1.36 l. in volume was filled with 613 g of ZSM-5 in the acid (H) form.

(3) Plastic Feed

Urban polyethylene film waste was collected and pulverized to a size of approximately 5 mm. The feed was placed in the feed supply zone 2 and melted in the screw feeder 5 and passed to the thermal cracking reaction zone 3. The vaporous product generated by thermal cracking was passed to the catalytic reaction zone 8 in which catalytic conversion was carried out respectively at the temperatures shown in Table 4 below.

TABLE 4

| Temperature | | | | | | | | | |
|---|---|---|---|---|---|---|---|---|---|
| First stage cracking (°C.) | Second stage catalytic conversion (°C.) | Amount of Feed supplied (g/h) | Yield of product (wt. %) | Yield of hydrocarbon oil (wt. %) | Specific weight of product | State of the hydrocarbon oil product | Range of carbon numbers | Average molecular weight (Mn) | Proportion of $C_5$–$C_{14}$ components (wt. %) |
| 430(1) | — | 680 | 100 | 94.0 | 0.773 | Wax at +20° C. | $C_5$–$C_{38}$ | 197.3 | 39.6 |
| 430 | 270 | 680 | 45.3 | 83.9 | 0.742 | Liquid at −20° C. | $C_5$–$C_{18}$ | 119.0 | 96.8 |
| 430 | 285 | 680 | 65.1 | 84.1 | 0.750 | " | $C_5$–$C_{18}$ | 127.1 | 91.1 |
| 430 | 295 | 680 | 93.1 | 90.4 | 0.751 | " | $C_5$–$C_{20}$ | 116.4 | 84.4 |
| 430 | 310 | 680 | 100 | 88.1 | 0.752 | " | $C_5$–$C_{19}$ | 119.9 | 84.6 |
| 430 | 320 | 680 | 100 | 79.6 | 0.754 | " | $C_5$–$C_{19}$ | 110.8 | 90.0 |
| 430 | 345 | 680 | 100 | 60.4 | 0.762 | " | $C_5$–$C_{14}$ | 103.9 | 100 |
| 450(2) | — | 706 | 100 | 91.1 | 0.776 | Wax at +20° C. | $C_5$–$C_{39}$ | 210.0 | 36.2 |
| 450 | 257 | 706 | 34.0 | 77.4 | 0.742 | Liquid at −20° C. | $C_5$–$C_{17}$ | 117.8 | 97.6 |
| 450 | 300 | 706 | 83.9 | 85.4 | 0.742 | " | $C_5$–$C_{19}$ | 109.5 | 89.5 |

TABLE 4-continued

| Temperature | | | | | | | | | |
|---|---|---|---|---|---|---|---|---|---|
| First stage cracking (°C.) | Second stage catalytic conversion (°C.) | Amount of Feed supplied (g/h) | Yield of product (wt. %) | Yield of hydrocarbon oil (wt. %) | Specific weight of product | State of the hydrocarbon oil product | Range of carbon numbers | Average molecular weight (Mn) | Proportion of $C_5$–$C_{14}$ components (wt. %) |
| 450 | 310 | 706 | 100 | 89.1 | 0.752 | " | $C_5$–$C_{21}$ | 129.8 | 73.3 |
| 450 | 328 | 706 | 100 | 81.9 | 0.752 | " | $C_5$–$C_{20}$ | 107.6 | 89.3 |
| 450 | 350 | 706 | 100 | 65.0 | 0.767 | " | $C_5$–$C_{15}$ | 108.4 | 98.8 |

Notes:
(1), (2)Comparative examples without the second stage catalytic cracking.

Results of the analysis of gas i.e. the thermal cracking products other than hydrocarbon oil, from the second stage, using a temperature of 430° C. in the first stage cracking tank and a temperature of 310° C. in the second stage catalytic conversion tower are given in Table 5 below (total gas component is taken as 100%):

TABLE 5

| Off-gas Composition | |
|---|---|
| | Percent |
| $H_2$ | 7.0 |
| $CH_4$ | 8.0 |
| $C_2H_4$ | 4.5 |
| $C_2H_6$ | 7.6 |
| $C_3H_8$ | 5.6 |
| $C_3H_6$ | 19.9 |
| i-$C_4H_{10}$ | 1.1 |
| n-$C_4H_{10}$ | 9.8 |
| i-$C_4H_8$ | 24.5 |
| i-$C_5H_{12}$ | 0.5 |
| n-$C_5H_{12}$ | 11.5 |

No attachment of carbon to the inner walls of the reaction vessel occurred for a long period of time.

We claim:

1. A process for producing a hydrocarbon oil of low pour point from plastic waste material, which comprises:

(i) thermally cracking molten plastic waste material in the liquid phase and (ii) contacting the thermal cracking products from (i) with an intermediate pore size zeolite at a temperature from 200° to 340° C. in the vapour phase to effect a catalytic cracking of the thermal cracking products.

2. A process according to claim 1 in which the thermal cracking products are catalytically cracked to a hydrocarbon oil which is substantially free of components having more than 22 carbon atoms.

3. A process according to claim 1 in which the plastic is a polyolefin.

4. A process according to claim 3 in which the thermal cracking is effected at a temperature of 390° to 500° C.

5. A process according to claim 3 in which the thermal cracking is carried out in the presence of an inorganic, porous particulate material.

6. A process according to claim 1 in which the zeolite is ZSM-5.

7. A process according to claim 1 in which the zeolite is maintained in a fixed bed reaction zone.

8. A process according to claim 1 in which the zeolite has a particle size of 0.1 to 10 mm.

* * * * *